US007610833B2

(12) United States Patent
McCabe

(10) Patent No.: US 7,610,833 B2
(45) Date of Patent: Nov. 3, 2009

(54) THREAD GRIPPING TOOL

(76) Inventor: Timothy P. McCabe, 10 Getchell La., Winslow, ME (US) 04901

( * ) Notice: Subject to any disclaimer, the term of this patent is extended or adjusted under 35 U.S.C. 154(b) by 6 days.

(21) Appl. No.: 11/558,597

(22) Filed: Nov. 10, 2006

(65) Prior Publication Data

US 2008/0110303 A1 May 15, 2008

(51) Int. Cl.
*B25B 7/02* (2006.01)
*B25B 13/50* (2006.01)
*B25B 13/28* (2006.01)

(52) U.S. Cl. ..... 81/426.5; 81/53.2

(58) Field of Classification Search ..... 82/186, 82/418, 426, 426.5; 269/260, 270; 81/186, 81/418, 426, 426.5, 53.2
See application file for complete search history.

(56) References Cited

U.S. PATENT DOCUMENTS

| | | | | | |
|---|---|---|---|---|---|
| 256,525 | A | * | 4/1882 | Whiting | 24/31 R |
| 663,208 | A | | 12/1900 | Wrensch | |
| 1,021,110 | A | * | 3/1912 | Niewohner | 411/244 |
| 1,442,486 | A | * | 1/1923 | Looke | 72/409.19 |
| 1,583,554 | A | * | 5/1926 | Hoover | 81/53.2 |
| 1,694,628 | A | * | 12/1928 | Sauveur | 81/53.2 |
| 1,753,080 | A | * | 4/1930 | Zwilling et al. | 81/3.6 |
| 1,807,264 | A | * | 5/1931 | Walker | 81/53.2 |
| 1,807,265 | A | * | 5/1931 | Walker | 81/53.2 |
| 1,815,500 | A | * | 7/1931 | Doan | 81/53.2 |
| 1,817,049 | A | * | 8/1931 | Weil | 81/53.2 |
| 1,828,523 | A | * | 10/1931 | Decker | 81/53.2 |
| 2,043,274 | A | * | 6/1936 | Wegner | 81/53.2 |
| 2,216,557 | A | * | 10/1940 | McKean | 81/112 |
| 2,257,327 | A | * | 9/1941 | Bradford | 411/433 |
| 2,367,480 | A | * | 1/1945 | Beswick | 411/433 |
| 2,381,597 | A | * | 8/1945 | Johnson | 81/455 |
| 2,434,354 | A | * | 1/1948 | Emmons | 81/53.2 |
| 2,681,582 | A | * | 6/1954 | Valvano | 81/53.2 |
| 2,694,329 | A | * | 11/1954 | Thompson et al. | 81/53.2 |
| 2,746,328 | A | * | 5/1956 | Valvano | 81/53.2 |
| 2,976,012 | A | * | 3/1961 | Allen | 415/9 |
| 3,181,340 | A | * | 5/1965 | Gruetzmacher | 72/409.01 |
| 4,132,146 | A | | 1/1979 | Uhlig | |
| 4,318,316 | A | * | 3/1982 | Guilliams | 81/426.5 |
| 4,462,731 | A | * | 7/1984 | Rovinsky et al. | 411/433 |
| 4,603,605 | A | * | 8/1986 | Miller | 81/53.2 |
| 5,027,678 | A | * | 7/1991 | McCollom | 81/53.2 |
| 6,206,620 | B1 | * | 3/2001 | Burns | 408/221 |
| 6,748,830 | B1 | * | 6/2004 | Swanstrom, Jr. | 81/423 |
| 6,821,070 | B1 | | 11/2004 | Thompson | |
| 7,272,994 | B1 | * | 9/2007 | Johnson | 81/13 |

* cited by examiner

*Primary Examiner*—David B Thomas
(74) *Attorney, Agent, or Firm*—Anthony D. Pellegrini, Esq.

(57) ABSTRACT

An improved hand tool for use with threaded rods, comprising a pair of partially threaded jaws whereby said partial threads of each jaw mate with the thread of the threaded rod, such that the jaws may be clamped onto either side of a threaded rod by a clamping device and simultaneously rotated, causing the threaded rod to rotate along with the jaws without damage to the thread of the threaded rod.

6 Claims, 11 Drawing Sheets

THREAD GRIPPING TOOL

BACKGROUND OF THE INVENTION

1. Technical Field

The invention relates generally to hand tools and more particularly to hand tools adapted for use with threaded rods.

2. Description of Prior Art

A threaded rod is a metal rod having a continuous thread about its exterior. The thread may be "right handed" or "left handed", describing how the thread winds about the rod. Most threaded rods have right hand threads. Unlike a bolt, a threaded rod does not have an end protuberance for gripping. A threaded rod is typically used by inserting one or both ends into threaded holes, though nuts may also be placed thereon.

The convention for describing a threaded rod is to provide the diameter of the threaded rod in fractions of an inch and to provide the number of threads per inch. For example, one might ask for a "½-13 threaded rod," which would describe a threaded rod having a nominal diameter of one half of an inch, and having thirteen threads to the inch as measured along a line parallel to the longitudinal axis of the threaded rod. Metric measurements of threaded rods are also common. In addition to the diameter of the threaded rod and the thread count, the thread of a threaded rod may also be characterized by its pitch and thread profile. Often these are standardized for ease of use, but they may also vary.

Threaded rods are commonly used in many mechanical applications. They are particularly found in small engines. Threaded rods may need to be adjusted or removed from their threaded holes, or reinserted therein. Over time, the threaded rod may become tightly bound to the threaded hole, making removal or adjustment of the threaded rod difficult, or the threaded hole may become dirty or damaged, making insertion of a threaded rod therein difficult.

Previously, persons needing to remove, adjust, or insert a tightly bound threaded rod from a threaded hole have had several less than optimal options. One method commonly used is the two-nut method. The user places two nuts onto the threaded rod, one on top of the other, thereby "locking" them against each other. After locking the nuts against each other, one of the nuts is gripped with a gripping device and then rotated, thereby rotating the threaded rod along with it (on a threaded rod having a right hand thread, to loosen the rod the lower nut is gripped and rotated, while to tighten the rod the upper nut is gripped and rotated; if the thread is left handed, the process is reversed). This method is time consuming and risks locking the nuts onto the threaded rod. It also cannot work where both ends of the threaded rod are inserted into threaded holes or are otherwise inaccessible.

A second method commonly used is to wrap a rag around the threaded rod and place a clamping device onto the rag, such as a vice grip or locking pliers. The rag is gripped with enough force to allow for rotation of the threaded rod. However, in applying sufficient force there is a risk that the threads of the rod will be damaged. The rag itself offers little protection. Gauging the exact amount of force necessary to move the rod but not to damage its thread is extremely difficult, and made even more so by the varying thicknesses of rags. The most common damage to a thread that occurs when using this method is to break or bend the crest of the thread, such that the distanced between the crests and/or flanks of the thread are no longer uniform. This prevents the thread from mating with another thread, either found in a nut or in a threaded hole.

A third method used is to grip the threaded rod directly with a clamping device. This frequently results in the destruction of a portion of the threads, through bending or breaking, and renders the threaded rod useless.

None of the foregoing methods adequately addresses the problem of removing, adjusting, or inserting a threaded rod easily and without damage to its threads. There is thus a need to overcome the deficiencies of the known art and to provide a device to easily and safely remove, adjust, or insert threaded rods.

It is therefore an objective of this invention to provide an improved hand tool for use with threaded rods which can be used to rotate a threaded rod with out damaging its thread.

It is a further objective of this invention to provide an improved hand tool for use with threaded rods which can be used to easily rotate a threaded rod.

It is yet a further objective of this invention to provide an improved hand tool for use with threaded rods which is easy and cost efficient to manufacture.

It is yet a further objective of this invention to provide a set of improved hand tools for use with many different sizes of threaded rods.

Other objectives of this invention will be evident from the following disclosure.

SUMMARY

The present invention is directed to an improved hand tool for use with threaded rods. The present invention comprises a pair of partially threaded jaws that are used to grip threaded rods in conjunction with a gripping tool, such as a "Vice-Grip"™ locking pliers or a channel lock pliers. The present invention allows the user to easily and quickly clamp onto any size threaded rod without damaging its threads, thereby allowing the user to rotate the threaded rod for insertion, adjustment, or extraction purposes.

Because threaded rods come in many different diameters, thread counts, pitch, and thread profiles, the present invention also contemplates a set of multiple pairs of jaws with varying characteristics as needed to mate with a wide range of threaded rods.

The present invention overcomes the deficiencies of the known art by providing a pair of partially threaded jaws that together may be placed around a threaded rod over its threads. The threads of the jaws mate with the threads of the threaded rod. The two jaws are placed on opposite sides of the threaded rod from each other, thereby substantially surrounding the threaded rod. A force applied to the jaws from opposite directions moves the jaws toward each other and against the threaded rod. The threads of the jaws are slightly deeper than the threads of the threaded rod, thereby allowing the jaws to grip the threaded rod at the root of its threads so as to avoid damaging the threads of the threaded rod.

In the preferred embodiment the pair of jaws is joined by a hinge. The hinge keeps the jaws together and allows them to be easily and properly aligned on the threaded rod when in use. Other embodiments are also contemplated, such as keeping the pair of jaws together by the use of magnets, or aligning the jaws with matched engagement pins and engagement holes.

In yet another embodiment, pivotally cooperating handles are attached to the jaws, so that a separate clamping device is not needed to apply a force to the jaws to grip the threaded rod. The handled configuration may be oriented whereby the handles are aligned substantially perpendicular to the threaded rod when the hand tool is in use, or oriented whereby the handles are aligned substantially parallel with the threaded rod, whichever better serves the purpose.

Other features and advantages of the invention are described below.

DETAILED DESCRIPTION OF THE INVENTION

Figure 1C:
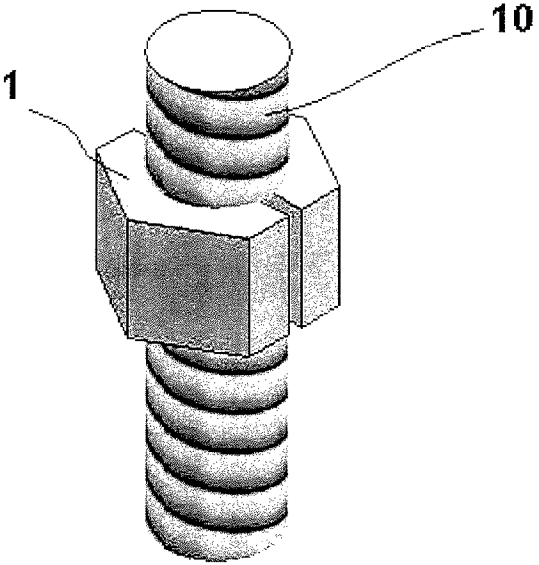
FIG. 1C is a perspective view of the embodiment of the present invention depicted in FIG. 1A in use on a threaded rod.

The hand tool 1 of the present invention is intended to be used with a threaded rod 10. The threaded rod 10 is characterized as having a core 14 and an external thread 12 formed on the core 14. The external thread 12 of the threaded rod 10 has a given nominal diameter, pitch, thread profile, thread count, and depth. The external thread 12 further has a pair of flanks 16 extending outward from the core 14 and meeting at a crest 18.

Figure 1A:
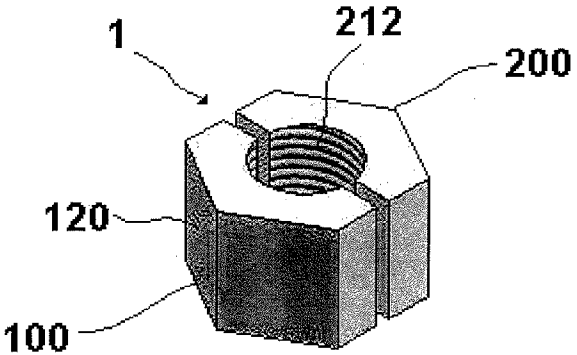
FIG. 1A is a perspective view of one embodiment of the present invention.
Figure 1B:
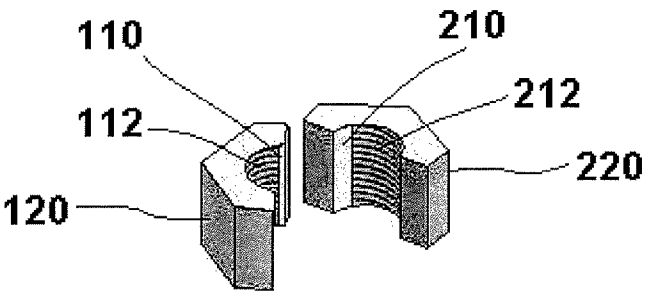
FIG. 1B is a perspective view of the embodiment of the present invention depicted in FIG. 1A, with the jaws separated.

The hand tool 1 of the present invention is comprised of a first jaw 100 and a second jaw 200. See FIGS. 1A and 1B. The first jaw 100 has an inner surface 110 and an outer surface 120. The inner surface 110 of the first jaw 100 is concave and has a shape substantially corresponding to an arc of a circle having a diameter slightly larger than the nominal diameter of the external thread 12 of the threaded rod 10. This arc has a length L, where L is less than the circumference of the circle. In the preferred embodiment the length L is just slightly less than one half the circumference of the circle. However, in other embodiments the length L may be longer or shorter than that of the preferred embodiment.

The inner surface 110 of the first jaw 100 has a series of internal screw threads 112 formed thereon. Each internal screw thread 112 has the same pitch (i.e., deviation from the normal), thread profile (i.e., shape of the thread), and thread count as the external thread 12 on the threaded rod 10. Each of the internal screw threads 112 of the first jaw 100 also comprises a pair of flanks 116 extending from the inner surface 110 of the first jaw 100 and meeting at a crest 118. Configured as such, the internal screw threads 112 are suitably adapted for mating engagement with the external thread 12 of the threaded rod 10.

The second jaw 200 likewise has an inner surface 210 and an outer surface 220. The inner surface 210 of the second jaw 200 is concave and has a shape substantially corresponding to an arc of the same circle defining the arc of the inner surface 110 of the first jaw 100. The arc of the inner surface 210 of the second jaw 200 has a length L', where L' is less than or equal to the circumference of the circle less length L. In the preferred embodiment the length L' is just slightly less than one half the circumference of the circle. Thus, in the preferred embodiment lengths L and L' together are just slightly less than the circumference of the circle. In the most preferred embodiment the first jaw 100 and the second jaw 200 have substantially the same shape. However, in other embodiments the lengths L and L' may be of unequal length.

The inner surface 210 of the second jaw 200 has a series of internal screw threads 212 formed thereon. Each internal screw thread 212 has the same pitch, thread profile, and thread count as the external thread 12 on the threaded rod 10. Each of the internal screw threads 212 of the second jaw 200 also comprises a pair of flanks extending from the inner surface 210 of the second jaw 200 and meeting at a crest. Configured as such, the internal screw threads 212 are suitably adapted for mating engagement with the external thread 12 of the threaded rod 10.

So configured, the first and second jaws 100,200 of the hand tool 1 may be simultaneously engaged upon opposite sides of the threaded rod 10, with the first and second jaws 100,200 lying in substantially the same plane with the threaded rod 10 positioned between them. See FIG. 1C. The first jaw 100 and the second jaw 200 are further suitably adapted to be moved toward each other and against the threaded rod 10, causing said the first and second jaws 100, 200 to exert a force on the threaded rod 10. This force must be sufficient such that a rotational movement of the hand tool 1 results in a corresponding movement of the threaded rod 10. In one embodiment the force is exerted by use of a clamping device, such as a Vice-Grip™ or a channel lock pliers.

Figure 5A:
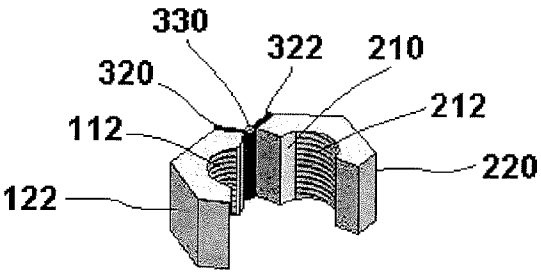
FIG. 5A is a perspective view of a hinged embodiment of the present invention in the open position.
Figure 8B:
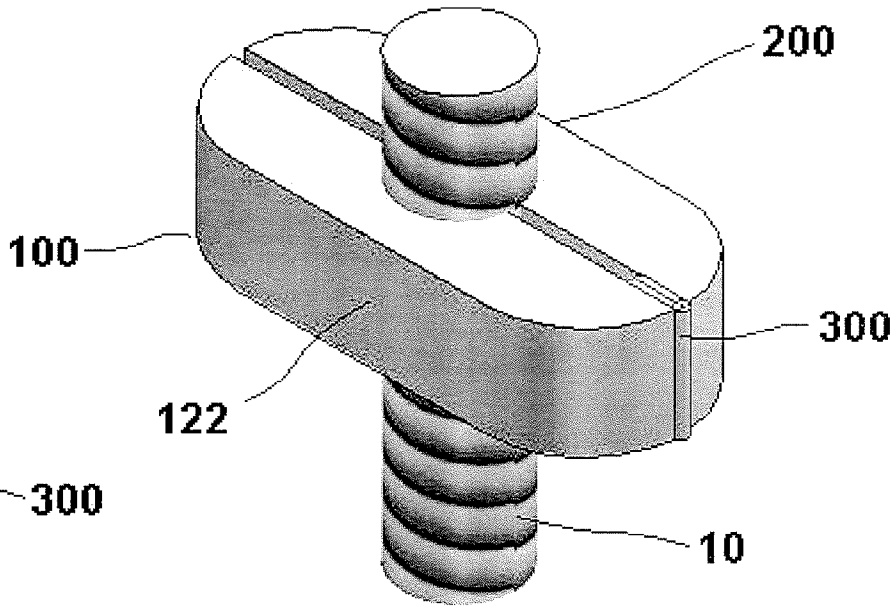
FIG. 8B is a perspective view of the embodiment of the present invention depicted in FIG. 8A in use on a threaded rod.
Figure 8A:
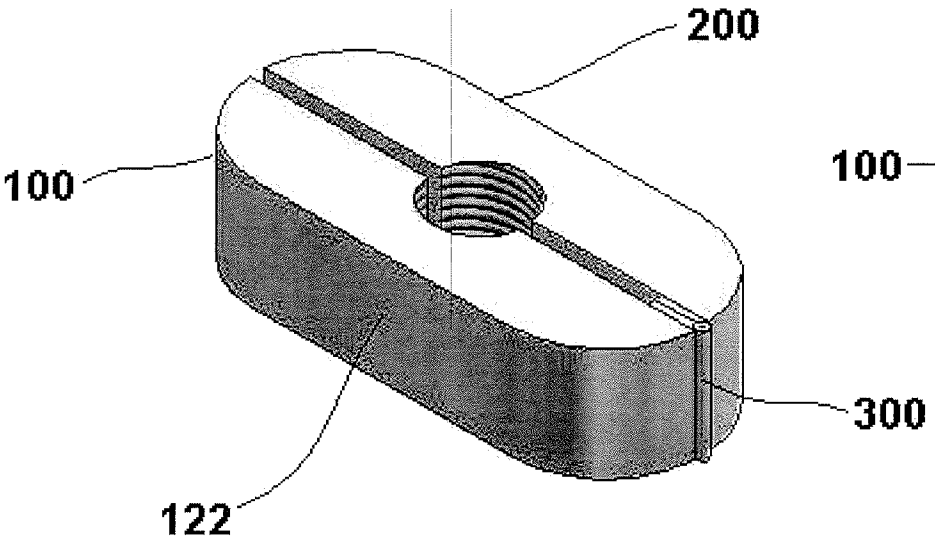
FIG. 8A is a perspective view of yet another embodiment of the present invention having yet another different outer surface configuration, and a hinge.

To accommodate the use of a clamping device, the outer surface 112 of the first jaw 100 may be substantially convex with at least one gripping side 122. See FIGS. 5A, 8A, and 8B. The gripping side 122 is substantially planar. Similarly, the outer surface 212 of the second jaw 200 may be substantially convex and have at least one gripping side 222, with the gripping side 222 of the second jaw 200 also being substantially planar. The gripping sides 122,222 of the first and second jaws 100,200 preferably are oriented directly opposite each other when the hand tool 1 is being used on a threaded rod 10, so that forces exerted on the jaws 100,200 by the clamping device are directed in substantially opposite directions to each other, toward the threaded rod 10. This results in the first and second jaws 100,200 being moved towards each other and against the threaded rod 10, whereby the jaws 100,200 frictionally engage the threaded rod 10. A rotational movement of the hand tool 1 then results in a corresponding movement of the threaded rod 10.

Figure 6C:
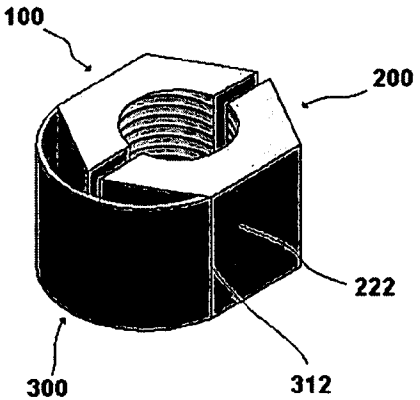
FIG. 6C and FIG. 6D are perspective views of another alternative embodiment of the hinge of the present invention.
Figure 6D:
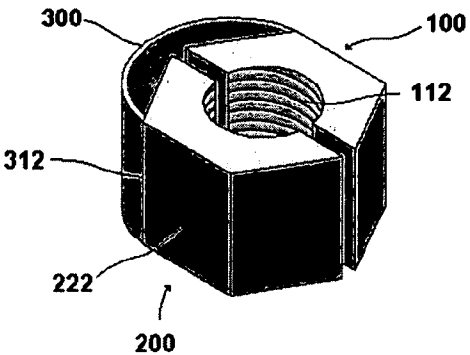
Figure 6A:
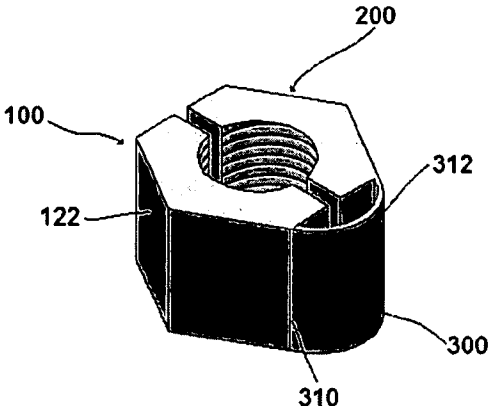
FIG. 6A and FIG. 6B are perspective views of an alternative embodiment of the hinge of the present invention.
Figure 6B:
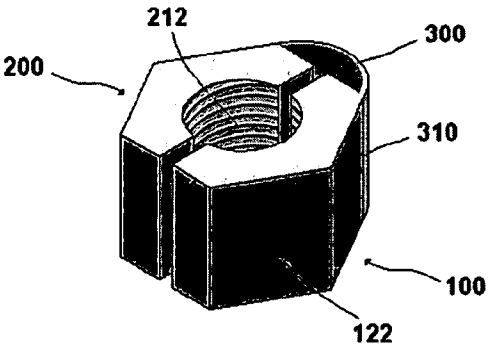
Figure 7B:
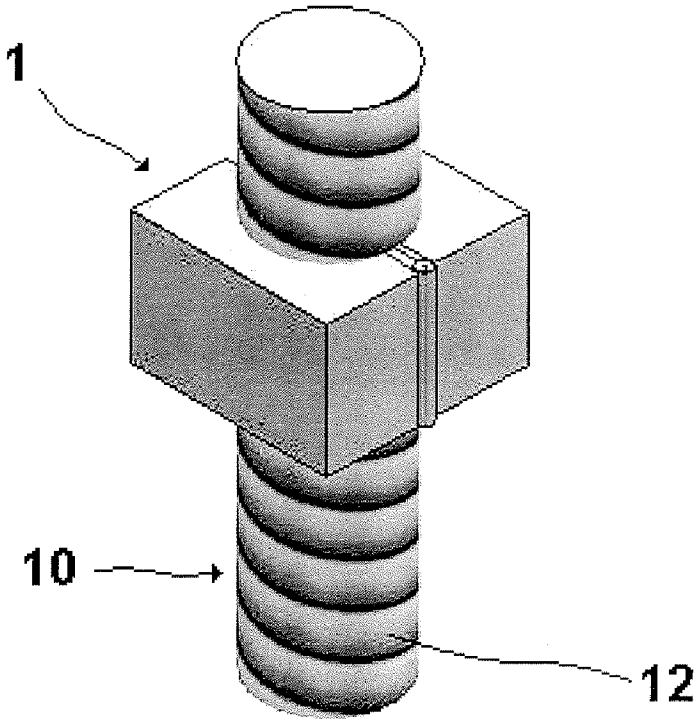
FIG. 7B is a perspective view of the embodiment of the present invention depicted in FIG. 7A in use on a threaded rod.

Various configurations of the outer surfaces 120,220 of the first and second jaws 100,200 which can accommodate a clamping device are contemplated by the present invention. One such configuration is for the hand tool 1 to have a substantially hexagonal profile. See FIGS. 1A, 1B, 1C, 4A, 4B, 6A, 6B, 6C, and 6D. The two jaws 100,200 may be formed by cutting a hexagonal nut in half, either from a flat side to a flat side, see FIGS. 6A and 6B, or from point to point, see FIGS. 6C and 6D. The latter configuration better aligns the gripping sides 122,222 of the jaws 100,200. Another such configuration is for the hand tool 1 to have a substantially square profile. See FIGS. 7A and 7B. Yet another such configuration is for the hand tool 1 to have a rounded sides. See FIGS. 8A and 8B. This last configuration makes it difficult to apply the clamping device to anything but the gripping sides 122,222 of the jaws 100,200, thereby ensuring the user applies the force properly to the hand tool 1. These and other configurations are all contemplated by the present invention.

To be usable as described, the jaws 100,200 of the hand tool 1 should be made of a very hard, durable material. Preferably, the first and second jaws 100,200 are made of a metal, such as steel, stainless steel, a metal alloy, and the like. Other materials exhibiting similar hardness and durability may also be used.

Figure 2:
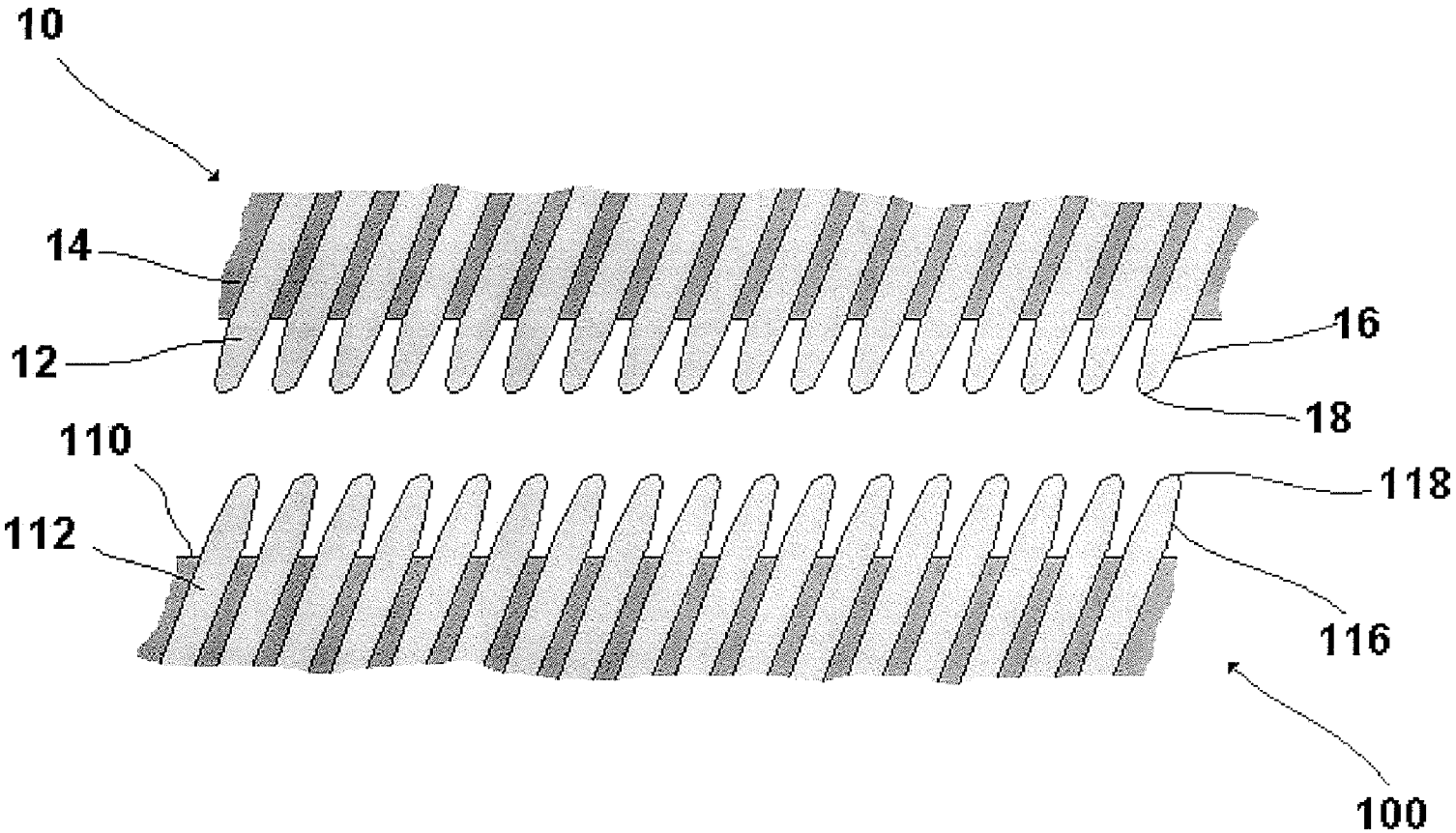
FIG. 2 is a schematic view of the external threads of the threaded rod and the internal threads of a jaw of the present invention.
Figure 3:
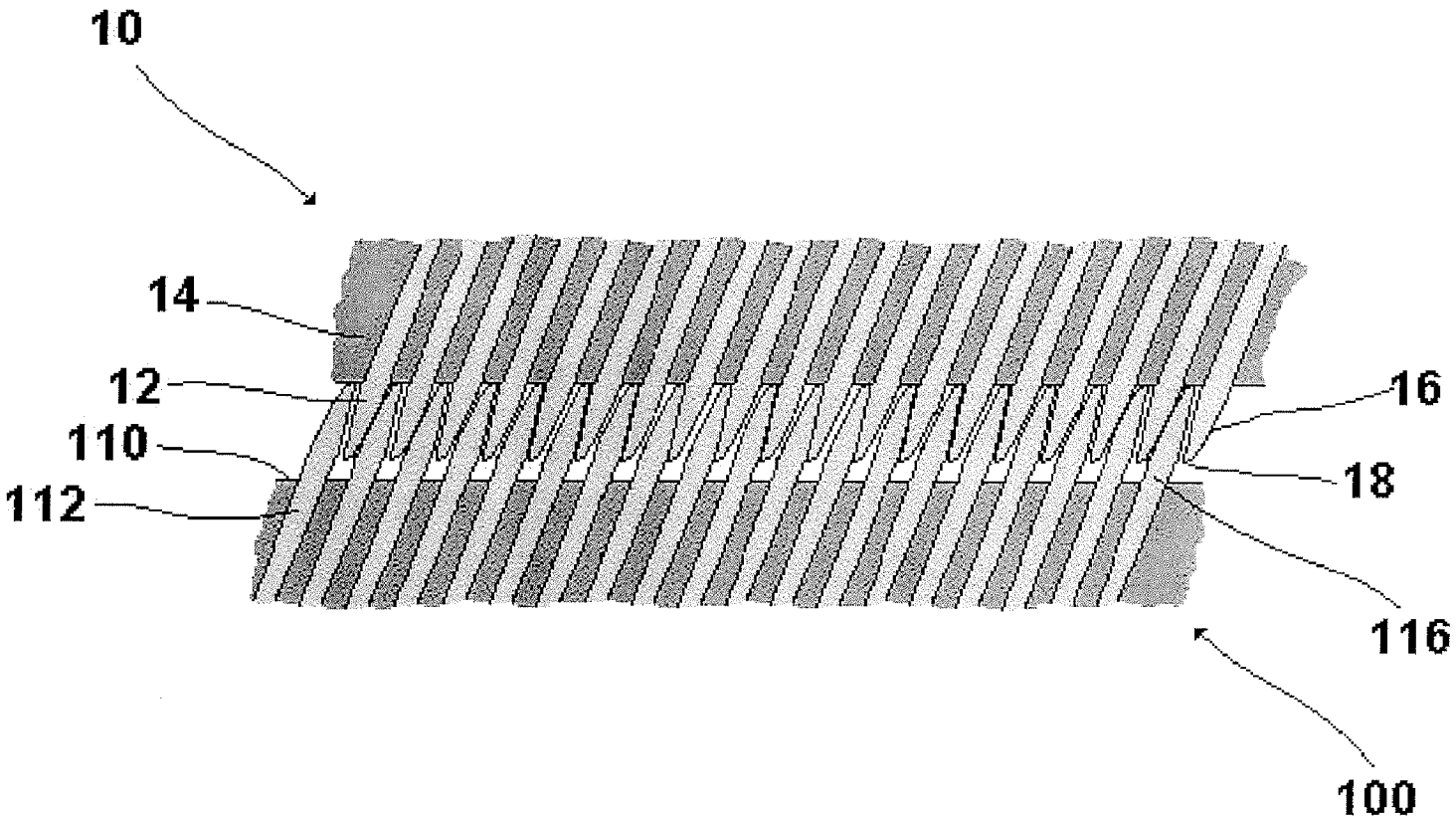
FIG. 3 is a schematic view of the eternal threads of the threaded rod engaged with the internal threads of the jaw of the present invention.

The hand tool 1 may be configured to further reduce the risk of damage to the external thread 12 of the threaded rod 10 during engagement. In this embodiment, for each internal screw thread 112 of the inner surface 110 of the first jaw 100, each internal screw thread 112 has a depth greater than the depth of the external thread 12 of the threaded rod 10. See FIG. 2. Thus, during engagement of the first jaw 100 with the threaded rod 10, the crest 16 of each internal screw thread 112 contacts the core 14 of the threaded rod 10 between the flanks 16 of the external thread 12 of the threaded rod 10. See FIG. 3. Moreover, the internal screw threads 112 of the first jaw 100 are configured to leave slight clearances between their flanks 116 and the flanks 16 of the external thread 12 of the threaded rod 10 when the first jaw 100 is engaged with the threaded rod 10. This combination of internal screw thread 112 depth and flank 116 clearance prevents the crest 16 of the external thread 12 of the threaded rod 10 from contacting the inner surface 110 of the first jaw 100 and minimizes the friction between the flanks 16 of the external thread 12 of the threaded rod 10 and the flanks 116 of the internal screw threads 112 of the first jaw 100, thereby further minimizing the risk of damage to the external thread 12 of the threaded rod 10. See FIG. 3. Likewise, the internal screw threads 212 of the second jaw 200 are configured in the same manner as those of the first jaw 100, such that the combination of internal screw thread 212 depth and flank clearance prevents the crest 16 of the external thread 12 of the threaded rod 10 from contacting the inner surface 210 of the second jaw 200 and minimizes the friction between the flanks 16 of the external thread 12 of the threaded rod 10 and the flanks of the internal screw threads 212 of the second jaw 200, minimizing the risk of damage to the external thread 12 of the threaded rod 10.

Figure 4B:
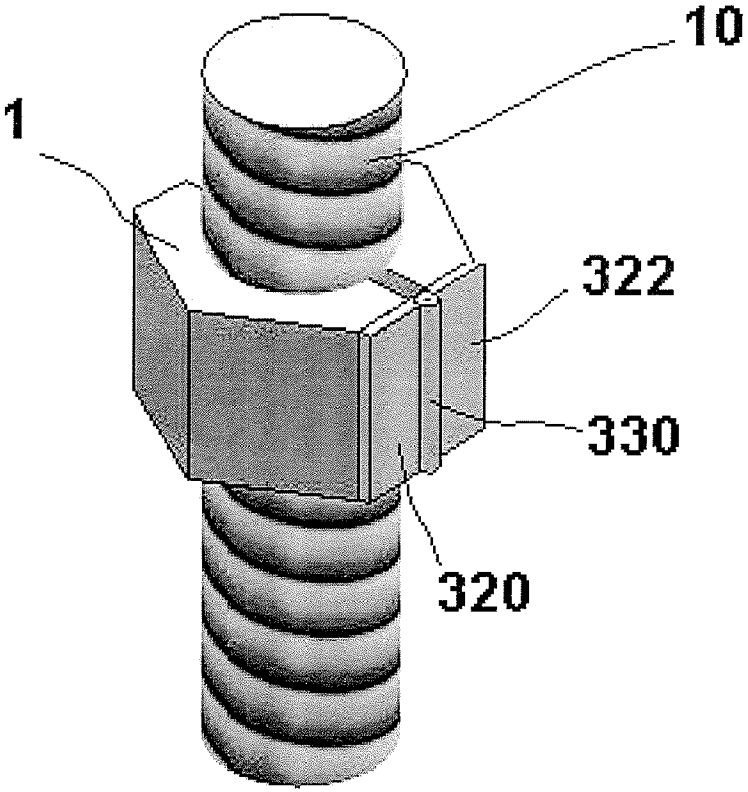
FIG. 4B is a perspective view of the embodiment of the present invention depicted in FIG. 4A in use on a threaded rod.
Figure 4A:
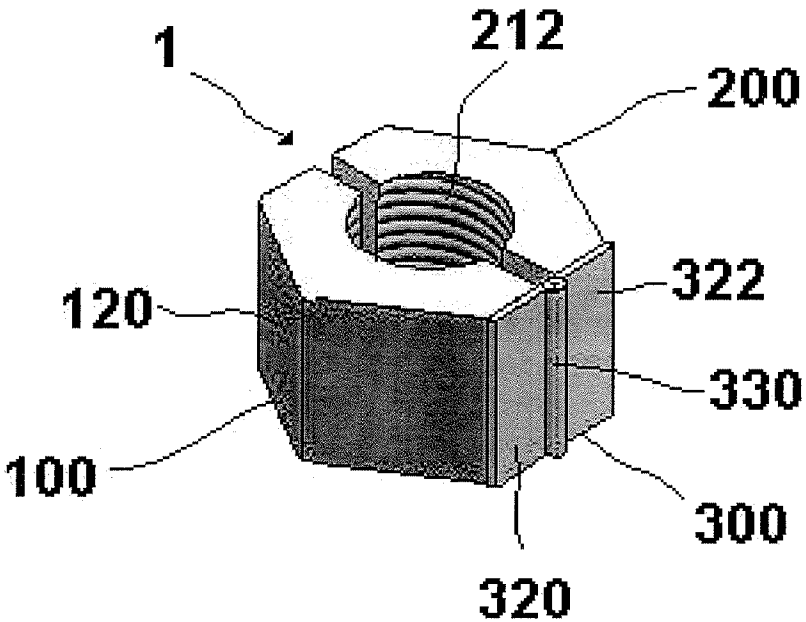
FIG. 4A is a perspective view of an embodiment of the present invention having a hinge.

The two jaws 100,200 of the hand tool 1 may be connected to each other by use of a hinge 300. See FIG. 4A. This serves two purposes: first, to keep the two jaws 100,200 together when not in use, so as to avoid losing one, which would render the hand tool 1 inoperative; and second, to keep the two jaws 100,200 properly aligned when the hand tool 1 is in use on a threaded rod 10, see FIG. 4B. The hinge 300 has a first end 310 and a second end 312. The first end 310 of the hinge 300 is attached to the outer surface 120 of the first jaw 100. The second end 312 of the hinge 300 is attached to the outer surface 220 of the second jaw 200. The hinge 300 is attached to the first and second jaws 100,200 in such a manner that the first jaw 100 and the second law 200 lie in substantially the same plane, and the inner surface 110 of the first jaw 100 is oriented towards the inner surface 210 of the second jaw 200. This is shown in FIG. 4A. The hinge 300 thus attached is suitably adapted to permit movement of the first and second jaws 100,200 toward and away from each other. In one embodiment the first end 310 of the hinge 300 is attached to the outer surface 120 of the first jaw 100 by a spot weld, and the second end 312 of the hinge 300 is attached to the outer surface 220 of the second jaw 200 by a spot weld. Other means of attaching the hinge to the first and second jaws 100,200 as are known in the art are also contemplated by the present invention.

Figure 5B:
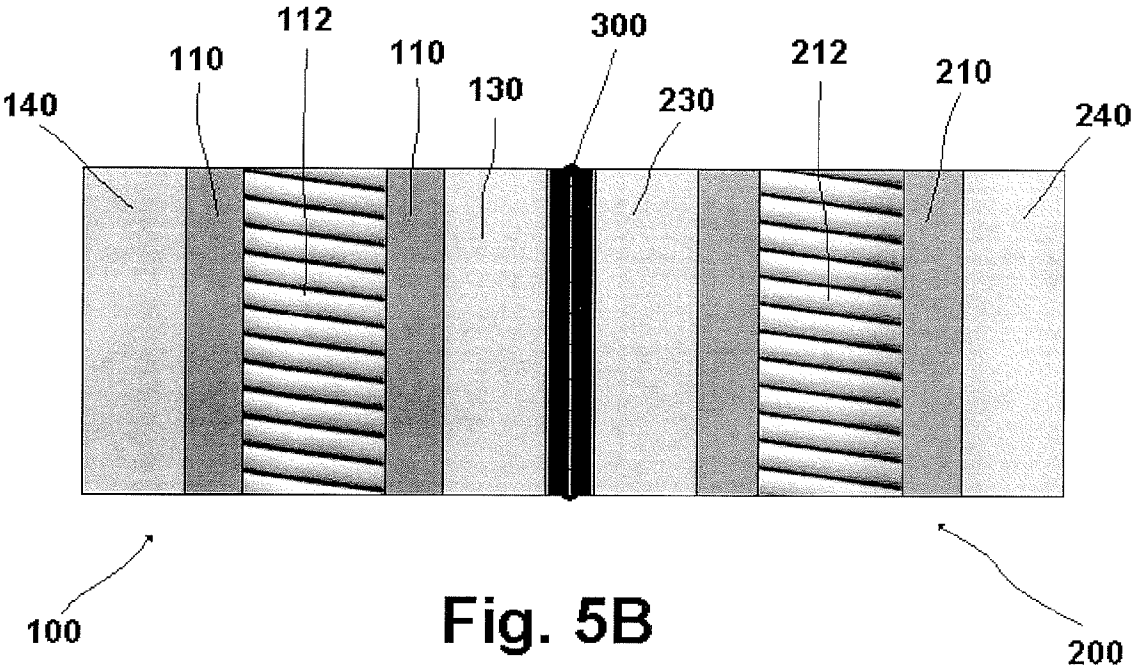
FIG. 5B is a front view of the embodiment of the present invention depicted in FIG. 5A.
Figure 7A:
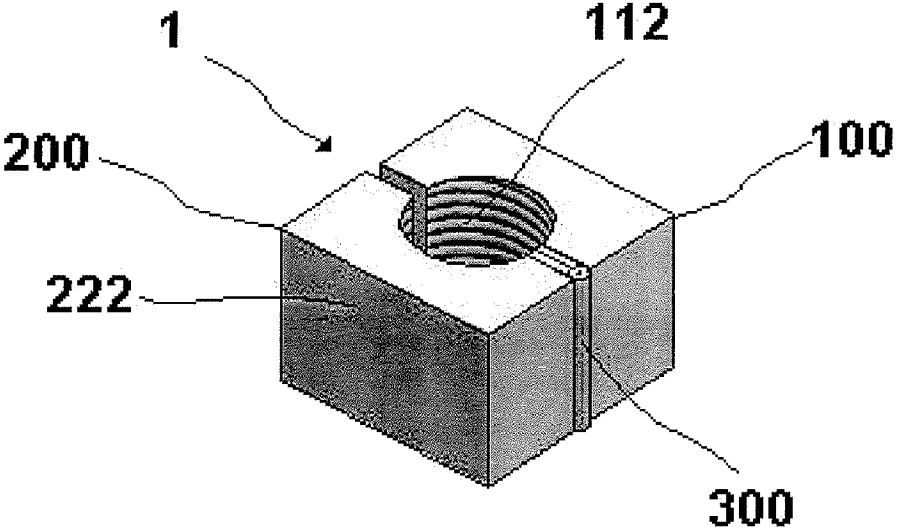
FIG. 7A is a perspective view of another embodiment of the present invention having a different outer surface configuration, and a hinge.

In one embodiment of the hinge 300, the hinge further comprises a substantially rigid first portion 320, a substantially rigid second portion 322, and a pivot mechanism 330. The pivot mechanism 330 is interposed between and integrated with the first and second portions 320,322 of the hinge 300. See FIG. 5A. The pivot mechanism 330 is suitably adapted to allow a pivotal movement between the first and second portions 320,322 in relation to each other. See FIG. 5B. An example of this configuration is a piano hinge. Other configurations are also contemplated. In another embodiment of the hinge 300, the first portion 320 is attached to the first face 130 of the first jaw 100, while the second portion 322 is attached to the first face 230 of the second jaw 200. This configuration is shown in FIG. 7A. Configured as such, the hinge 300 ensures a minimal amount of separation between the first and second jaws 100,200 when the hand tool 1 is placed around a threaded rod 10. See FIG. 7B.

In yet another embodiment of the hinge 300, the hinge is substantially monolithic and flexible. This is shown in FIGS. 6A, 6B, 6C, and 6D. This one piece hinge 300 has a springing action whereby an application of a force to the hinge 300, either directly or indirectly through the jaws 100,200, will permit the hinge 300 to flex and a removal of that force will permit the hinge 300 to return to its unflexed state. A flat metal spring is an example of this type of hinge 300. Another example is for the hinge 300 to be a formed piece of spring steel, curved between the first end 310 and the second end 312. See FIGS. 6A, 6B, 6C, and 6D. Other configurations of the hinge 300 are also contemplated. These configurations present low cost alternative hinge designs that are nonetheless effective.

Figure 11A:
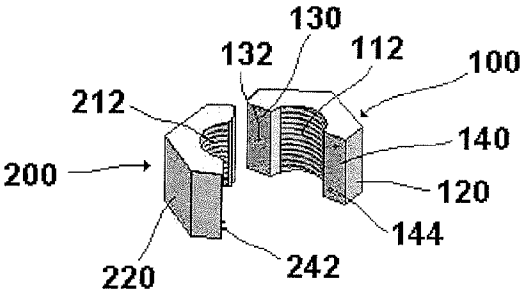
FIG. 11A is a perspective view of an embodiment of the present invention comprising engagement pins and engagement hole for alignment purposes.
Figure 11B:
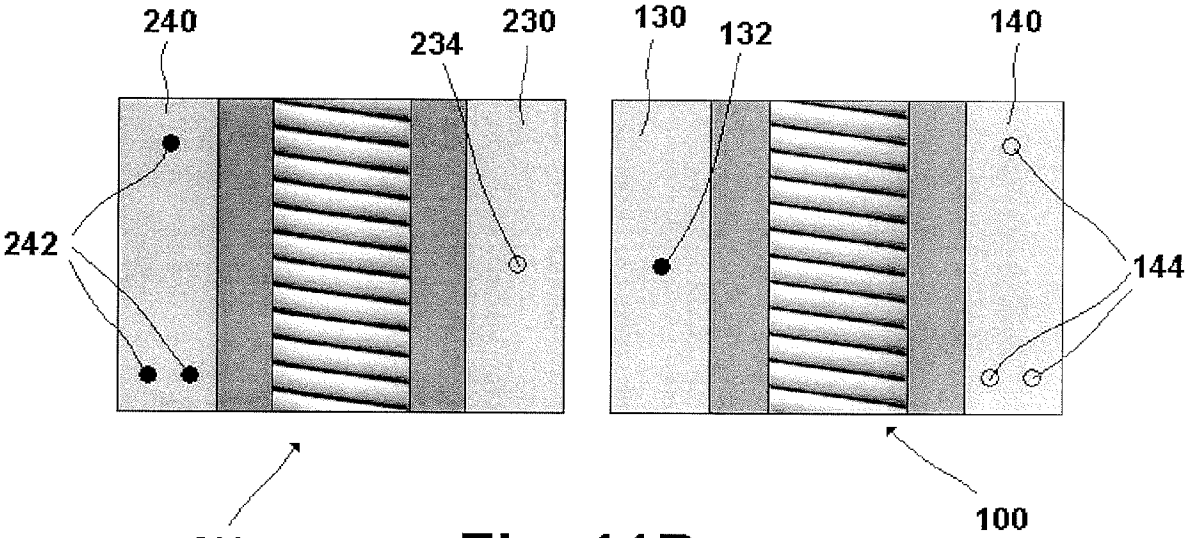
FIG. 11B is a front view of the embodiment of the present invention depicted in FIG. 11A.

In another embodiment, means other than a hinge 300 are used to keep the two jaws 100,200 together when not in use and to keep the two jaws 100,200 properly aligned when the hand tool 1 is in use on a threaded rod 10. In one such embodiment, the outer surface 120 of the first jaw 100 further comprises a first end and a second end located opposite the first end. On the outer surface 120 of the first jaw 100 at the first end is a first face 130. On the outer surface 120 of the first jaw 100 at the second end is a second face 140. Similarly, the outer surface 220 of the second jaw 200 has a first face 230 and a second face 240. The first face 130 of the first jaw 100 is substantially planar, as are the second face 140 of the first jaw 100 and the first and second faces 230,240 of the second jaw 200. The first face 130 of the first jaw 100 is oriented towards and is substantially aligned with the first face 230 of the second jaw 200, and the second face 140 of the first jaw 100 is oriented towards and is substantially aligned with the second face 240 of the second jaw 200, when the first and second jaws 100,200 of the hand tool 1 are simultaneously engaged upon opposite sides of the threaded rod 10. See FIGS. 11A and 11B.

In this embodiment, the first face 130 of the first jaw 100 has one or more engagement pins 132 depending from the first face 130 of the first jaw 100 and oriented substantially perpendicular to the first face 130 of the first jaw 100. The first face 230 of the second jaw 200 has a like number of engagement holes 234 formed into the first face 230 of the second jaw 200, each such engagement hole 234 suitably adapted to receive a corresponding engagement pin 132 from the first jaw 100 when the first and second jaws 100,200 of the hand tool 1 are simultaneously engaged upon opposite sides of the threaded rod 10. See FIGS. 11A and 11B. Additionally, the second face 140 of the first jaw 100 may have one or more engagement pins depending from the second face 140 of the first jaw 100 and oriented substantially perpendicular to the second face 140 of the first jaw 100, and the second face 240 of the second jaw 200 has a like number of engagement holes formed into the second face 240 of the second jaw 200, each such engagement hole suitably adapted to receive a corresponding engagement pin from the first jaw 100. Alternatively, the second face 140 of the first jaw 100 may have one or more engagement holes 144 formed into the second face 140 of the first jaw 100, and the second face 240 of the second jaw 200 may have a like number of engagement pins 242 depending from the second face 240 of the second jaw 200 and oriented substantially perpendicular to the second face 240 of the second jaw 200, each such engagement hole 144 suitably adapted to receive a corresponding engagement pin 242 from the second jaw 200. The arrangement of engagement pins and engagement holes serves to properly align the two jaws 100,200 of the hand tool 1, and also frictionally connects and keeps the two jaws 100,200 together when they are not being used.

In another embodiment, the first face 130 of the first jaw 100 is magnetically attracted to the first face 230 of the second jaw 200, and the second face 140 of the first jaw 100 is magnetically attracted to the second face 240 of the second jaw 200. This accomplishes the purpose of holding the two jaws 100,200 together without use of a hinge.

Figure 9B:
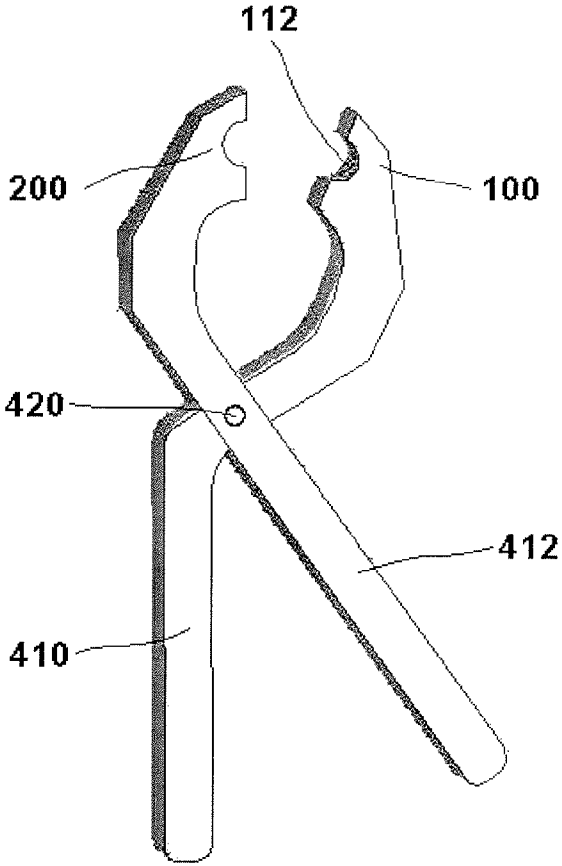
FIG. 9B is a perspective view of the embodiment of the present invention depicted in FIG. 9A in the open position.
Figure 9A:
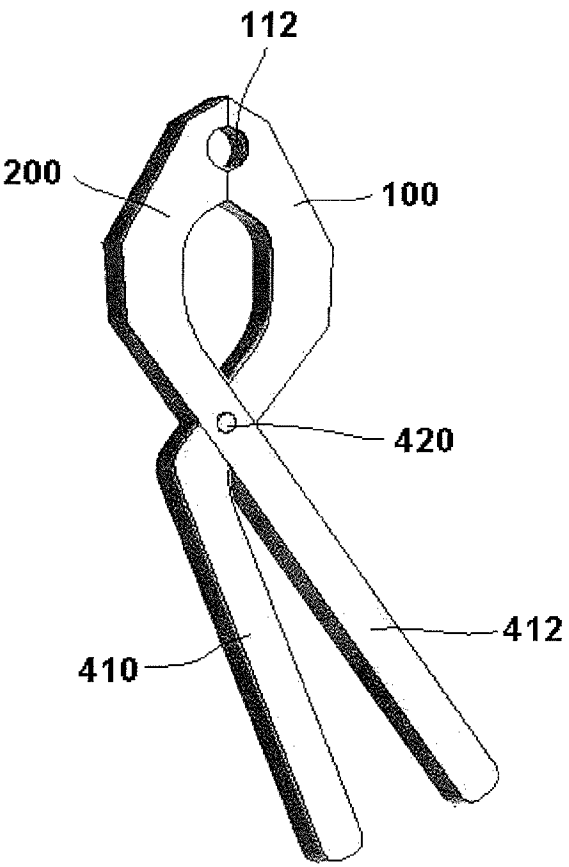
FIG. 9A is a perspective view of an alternative embodiment of the present invention having handles.
Figure 10C:
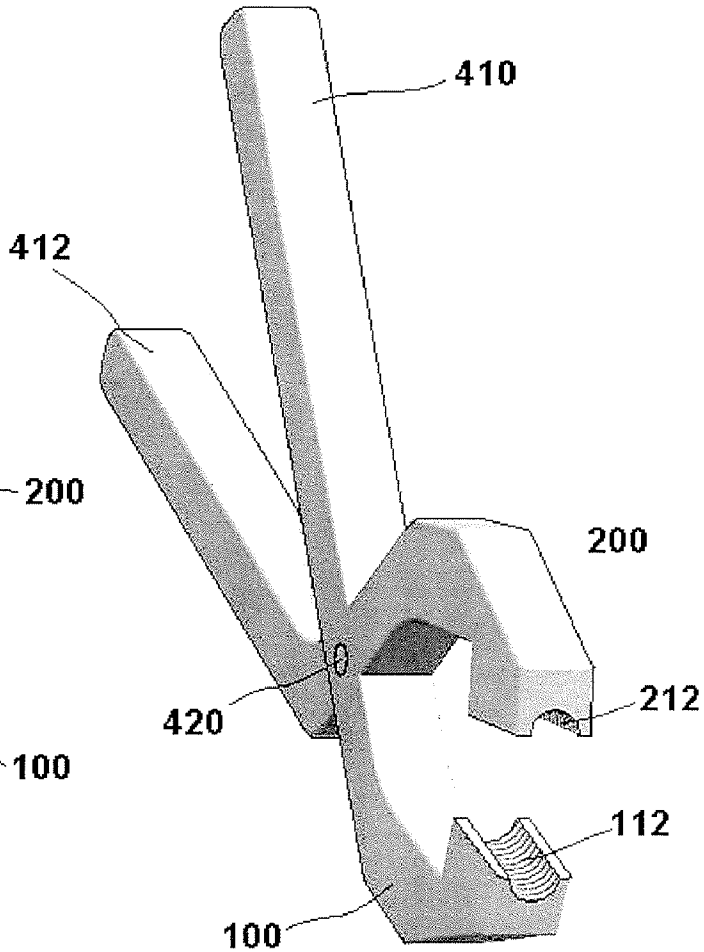
FIG. 10C is a perspective view of the embodiment of the present invention depicted in FIG. 10A in the open position.
Figure 10B:
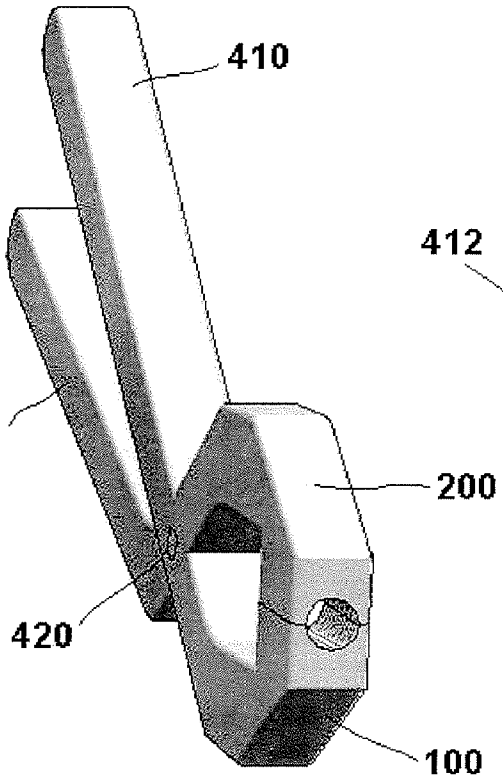
FIG. 10B is a perspective view of the embodiment of the present invention depicted in FIG. 10A.
Figure 10A:
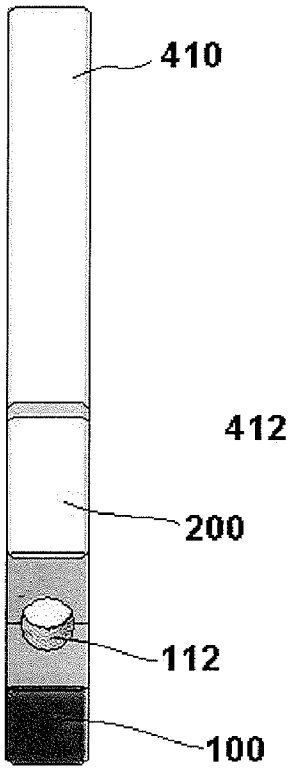
FIG. 10A is a front view of another alternative embodiment of the present invention having handles.

In an alternative embodiment of the hand tool 1, the hand tool 1 further comprises a first handle 410 and a second handle 412. The first handle 410 is substantially elongate and rigid, and is fixedly attached to the first jaw 100. The second handle 412 is substantially elongate and rigid, and is fixedly attached to the second jaw 200. The first and second handles 410,412 are in connection with each other by a pivot 420. The pivot 420 is suitably adapted to pivotally connect the first handle 410 with the second handle 412. See FIGS. 9A, 9B, 10A, 10B, and 10C. In this embodiment, manual manipulation of the first and second handles 410,412 causes the first and second jaws 100,200 to be moved toward and away from each other, thereby permitting the first and second jaws 100,200 to simultaneously engage the threaded rod 10 and permitting the first and second jaws 100,200 to be disengaged from the threaded rod 10, without need for a separate clamping device. The handled configuration may be oriented whereby the handles 410,412 are aligned substantially perpendicular to the threaded rod 10 when the hand tool 1 is in use, see FIGS. 9A and 9B, or oriented whereby the handles 410,412 are aligned substantially parallel with the threaded rod 10, see FIGS. 10A, 10B, and 10C, whichever better serves the purpose.

The present invention also contemplates a set of hand tools 1 suitable for use with a plurality of threaded rods 10. Each set may be configured to work with a corresponding set of threaded rods 10, for example threaded rods 10 all having the same combination of pitch, thread profile, and thread count but having different nominal diameters. In such a set, the most common sizes of threaded rods 10 would have corresponding hand tools 1 designed to fit them. This is analogous to socket sets which contain various sockets sized to fit common nut sizes. The hand tools 1 may be configured with Imperial measurements (e.g., based on inches) or metric.

Modifications and variations may be made to the disclosed embodiments of the present invention without departing from the subject or spirit of the present invention as defined in the following claims.

I claim:

1. A hand tool suitable for use with a threaded rod, said threaded rod having a core and an external thread formed thereon with a given nominal diameter, pitch, thread profile, thread count, and depth, said external thread further having a pair of flanks extending from the core and meeting at a crest, said hand tool comprising a first jaw, said first jaw having an inner surface, with said inner surface of the first jaw being concave and having a shape substantially corresponding to an arc of a circle having a diameter slightly larger than the nominal diameter of the external thread of the threaded rod, said arc having a length L, L being less than the circumference of said circle, said inner surface of the first jaw having a series of internal screw threads formed thereon, each said internal screw thread having the same pitch, thread profile, and thread count as the external thread on the threaded rod and further having a pair of flanks extending from the inner surface of the first jaw and meeting at a crest, said internal screw threads suitably adapted for mating engagement with the external thread on the threaded rod, and said first jaw having an outer surface, with said outer surface of the first jaw being substantially convex and having at least one gripping side, said gripping side being substantially planar;

a second jaw, said second jaw having an inner surface, with said inner surface of the second jaw being concave and having a shape substantially corresponding to an arc of said circle, said arc having a length L' less than or equal to the circumference of said circle less length L, said inner surface of the second jaw having a series of internal screw threads formed thereon, each said internal screw thread having the same pitch, thread profile, and thread count as the external thread on the threaded rod and further having a pair of flanks extending from the inner surface of the second jaw and meeting at a crest, said internal screw threads suitably adapted for mating engagement with the external thread on the threaded rod, and said second jaw having an outer surface, with said outer surface of the second jaw being substantially convex and having at least one gripping side, said gripping side being substantially planar; and a hinge, said hinge having a first end and a second end, with said first end of the hinge attached to the outer surface of the first jaw and said second end of the hinge attached to the outer surface of the second jaw, such that the first jaw and the second law lie in substantially the same plane and the inner surface of the first jaw is oriented towards the inner surface of the second jaw, with said hinge suitably adapted to permit movement of the first and second jaws toward and away from each other, wherein the first end of the hinge is attached to the outer surface of the first jaw by a spot weld and the second end of the hinge is attached to the outer surface of the second jaw by a spot weld, whereby the first and second jaws of the hand tool are simultaneously engaged upon opposite sides of the threaded rod, said first and second jaws lying in substantially the same plane and said threaded rod positioned between said first and second jaws, with at least one gripping side of the outer surface of the first jaw and at least one gripping side of the outer surface of the second jaw suitably adapted to being simultaneously engaged by a clamping device, said clamping device suitably adapted to move the first and second jaws toward each other and against the threaded rod causing said first and second jaws to exert sufficient pressure on the threaded rod such that a rotational movement of the hand tool results in a corresponding movement of the threaded rod.

2. A hand tool suitable for use with a threaded rod, said threaded rod having a core and an external thread formed thereon with a given nominal diameter, pitch, thread profile, thread count, and depth, said external thread further having a pair of flanks extending from the core and meeting at a crest, said hand tool comprising a first jaw, said first jaw having an inner surface, with said inner surface of the first jaw being concave and having a shape substantially corresponding to an arc of a circle having a diameter slightly larger than the nominal diameter of the external thread of the threaded rod, said arc having a length L, L being less than the circumference of said circle, said inner surface of the first jaw having a series of internal screw threads formed thereon, each said internal screw thread having the same pitch, thread profile, and thread count as the external thread on the threaded rod and further having a pair of flanks extending from the inner surface of the first jaw and meeting at a crest, said internal screw threads suitably adapted for mating engagement with the external thread on the threaded rod, said first jaw having an outer surface, with said outer surface of the first jaw being substantially convex and having at least one gripping side, said gripping side being substantially planar, and having a first end and a second end opposite the first end, and said first jaw having a first face and a second face, with said first face of the first jaw being substantially planar and located at the first end of the outer surface of the first jaw adjacent to the inner surface of the first jaw, and having one or more engagement pins depending from the first face of the first jaw and oriented substantially perpendicular to the first face of the first jaw, and with said second face of the first jaw being substantially planar and located at the second end of the outer surface of the first jaw adjacent to the inner surface of the first jaw, and having one or more engagement pins depending from the second face of the first jaw and oriented substantially perpendicular to the second face of the first jaw; and a second jaw, said second jaw having an inner surface, with said inner surface of the second jaw being concave and having a shape substantially corresponding to an arc of said circle, said arc having a length L' less than or equal to the circumference of said circle less length L, said inner surface of the second jaw having a series of internal screw threads formed thereon, each said internal screw thread having the same pitch, thread profile, and thread count as the external thread on the threaded rod and further having a pair of flanks extending from the inner surface of the second jaw and meeting at a crest, said internal screw threads suitably adapted for mating engagement with the external thread on the threaded rod, said second jaw having an outer surface, with said outer surface of the second jaw being substantially convex and having at least one gripping side, said gripping side being substantially planar, and having a first end and a second end opposite the first end, and said second jaw having a first face and a second face, said first face of the second jaw being substantially planar and located at the first end of the outer surface of the second jaw adjacent to the inner surface of the second jaw, and having a number of engagement holes corresponding to the number of engagement pins of the first face of the first jaw formed into the first face of the second jaw, each said engagement hole suitably adapted to receive an engagement pin when the first and second jaws of the hand tool are simultaneously engaged upon opposite sides of the threaded rod, and said second face of the second jaw being substantially planar and located at the second end of the outer surface of the second jaw adjacent to the inner surface of the second jaw;

with said second face of the second jaw being substantially planar and located at the second end of the outer surface of the second jaw adjacent to the inner surface of the second jaw, and having a number of engagement holes corresponding to the number of engagement pins of the second face of the first jaw formed into the second face of the second jaw, each said engagement hole suitably adapted to receive an engagement pin when the first and second jaws of the hand tool are simultaneously engaged upon opposite sides of the threaded rod;

with the first face of the first jaw oriented towards and substantially aligned with the first face of the second jaw, and the second face of the first jaw oriented towards and substantially aligned with the second face of the second jaw when the first and second jaws of the hand tool are simultaneously engaged upon opposite sides of the threaded rod, whereby the first and second jaws of the hand tool are simultaneously engaged upon opposite sides of the threaded rod, said first and second jaws lying in substantially the same plane and said threaded rod positioned between said first and second jaws, with at least one gripping side of the outer surface of the first jaw and at least one gripping side of the outer surface of the second jaw suitably adapted to being simultaneously engaged by a clamping device, said clamping device suitably adapted to move the first and second jaws toward each other and against the threaded rod causing said first and second jaws to exert sufficient pressure on the threaded rod such that a rotational movement of the hand tool results in a corresponding movement of the threaded rod.

3. A hand tool suitable for use with a threaded rod, said threaded rod having a core and an external thread formed thereon with a given nominal diameter, pitch, thread profile, thread count, and depth, said external thread further having a pair of flanks extending from the core and meeting at a crest, said hand tool comprising a first jaw, said first jaw having an inner surface, with said inner surface of the first jaw being concave and having a shape substantially corresponding to an arc of a circle having a diameter slightly larger than the nominal diameter of the external thread of the threaded rod, said arc having a length L, L being less than the circumference of said circle, said inner surface of the first jaw having a series of internal screw threads formed thereon, each said internal screw thread having the same pitch, thread profile, and thread count as the external thread on the threaded rod and further having a pair of flanks extending from the inner surface of the first jaw and meeting at a crest, said internal screw threads suitably adapted for mating engagement with the external thread on the threaded rod, said first jaw having an outer surface, with said outer surface of the first jaw being substantially convex and having at least one gripping side, said gripping side being substantially planar, and having a first end and a second end opposite the first end, and said first jaw having a first face and a second face, with said first face of the first jaw being substantially planar and located at the first end of the outer surface of the first jaw adjacent to the inner surface of the first jaw, and having one or more engagement pins depending from the first face of the first jaw and oriented substantially perpendicular to the first face of the first jaw, and with said second face of the first jaw being substantially planar and located at the second end of the outer surface of the first jaw adjacent to the inner surface of the first jaw, and having one or more engagement holes formed into the second face of the first jaw, each said engagement hole suitably adapted to receive an engagement pin when the first and second jaws of the hand tool are simultaneously engaged upon opposite sides of the threaded rod;

a second jaw, said second jaw having an inner surface, with said inner surface of the second jaw being concave and having a shape substantially corresponding to an arc of said circle, said arc having a length L' less than or equal to the circumference of said circle less length L, said inner surface of the second jaw having a series of internal screw threads formed thereon, each said internal screw thread having the same pitch, thread profile, and thread count as the external thread on the threaded rod and further having a pair of flanks extending from the inner surface of the second jaw and meeting at a crest, said internal screw threads suitably adapted for mating engagement with the external thread on the threaded rod, said second jaw having an outer surface, with said outer surface of the second jaw being substantially convex and having at least one gripping side, said gripping side being substantially planar, and having a first end and a second end opposite the first end, and said second jaw having a first face and a second face, said first face of the second jaw being substantially planar and located at the first end of the outer surface of the second jaw adjacent to the inner surface of the second jaw, and having a number of engagement holes corresponding to the number of engagement pins of the first face of the first jaw formed into the first face of the second jaw, each said engagement hole suitably adapted to receive an engagement pin when the first and second jaws of the hand tool are simultaneously engaged upon opposite sides of the threaded rod, and said second face of the second jaw being substantially planar and located at the second end of the outer surface of the second jaw adjacent to the inner surface of the second jaw;

with said second face of the second jaw being substantially planar and located at the second end of the outer surface of the second jaw adjacent to the inner surface of the second jaw, and having a number of engagement pins corresponding to the number of engagement holes of the second face of the first jaw depending from the second face of the second jaw and oriented substantially perpendicular to the second face of the second jaw;

with the first face of the first jaw oriented towards and substantially aligned with the first face of the second jaw, and the second face of the first jaw oriented towards and substantially aligned with the second face of the second jaw when the first and second jaws of the hand tool are simultaneously engaged upon opposite sides of the threaded rod, whereby the first and second jaws of the hand tool are simultaneously engaged upon opposite sides of the threaded rod, said first and second jaws lying in substantially the same plane and said threaded rod positioned between said first and second jaws, with at least one gripping side of the outer surface of the first jaw and at least one gripping side of the outer surface of the second jaw suitably adapted to being simultaneously engaged by a clamping device, said clamping device suitably adapted to move the first and second jaws toward each other and against the threaded rod causing said first and second jaws to exert sufficient pressure on the threaded rod such that a rotational movement of the hand tool results in a corresponding movement of the threaded rod.

4. A hand tool suitable for use with a threaded rod, said threaded rod having a core and an external thread formed thereon with a given nominal diameter, pitch, thread profile, thread count, and depth, said external thread further having a pair of flanks extending from the core and meeting at a crest, said hand tool comprising a first jaw, said first jaw having an inner surface, with said inner surface of the first jaw being concave and having a shape substantially corresponding to an arc of a circle having a diameter slightly larger than the nominal diameter of the external thread of the threaded rod, said arc having a length L, L being less than the circumference of said circle, said inner surface of the first jaw having a series of internal screw threads formed thereon, each said internal screw thread having the same pitch, thread profile, and thread count as the external thread on the threaded rod and further having a pair of flanks extending from the inner surface of the first jaw and meeting at a crest, said internal screw threads suitably adapted for mating engagement with the external thread on the threaded rod, said first jaw having an outer surface, with said outer surface of the first jaw being substantially convex and having at least one gripping side, said gripping side being substantially planar, and having a first end and a second end opposite the first end, and said first jaw having a first face and a second face, said first face of the first jaw being substantially planar and located at the first end of the outer surface of the first jaw adjacent to the inner surface of the first jaw, and said second face of the first jaw being substantially planar and located at the second end of the outer surface of the first jaw adjacent to the inner surface of the first jaw; and a second jaw, said second jaw having an inner surface, with said inner surface of the second jaw being concave and having a shape substantially corresponding to an arc of said circle, said arc having a length L' less than or equal to the circumference of said circle less length L, said inner surface of the second jaw having a series of internal screw threads formed thereon, each said internal screw thread having the same pitch, thread profile, and thread count as the external thread on the threaded rod and further having a pair of flanks extending from the inner surface of the second jaw and meeting at a crest, said internal screw threads suitably adapted for mating engagement with the external thread on the threaded rod, said second jaw having an outer surface, with said outer surface of the second jaw being substantially convex and having at least one gripping side, said gripping side being substantially planar, and having a first end and a second end opposite the first end, and said second jaw having a first face and a second face, said first face of the second jaw being substantially planar and located at the first end of the outer surface of the second jaw adjacent to the inner surface of the second jaw, and said second face of the second jaw being substantially planar and located at the second end of the outer surface of the second jaw adjacent to the inner surface of the second jaw;

with the first face of the first jaw oriented towards and substantially aligned with the first face of the second jaw, with the second face of the first jaw oriented towards and substantially aligned with the second face of the second jaw when the first and second jaws of the hand tool are simultaneously engaged upon opposite sides of the threaded rod, with the first face of the first jaw magnetically attracted to the first face of the second jaw, and with the second face of the first jaw magnetically attracted to the second face of the second jaw, whereby the magnetic attraction of the first face of the first jaw to the first face of the second jaw and the magnetic attraction of the second face of the first jaw to the second face of the second jaw is capable of holding the first and second jaws together, whereby the first and second jaws of the hand tool are simultaneously engaged upon opposite sides of the threaded rod, said first and second jaws lying in substantially the same plane and said threaded rod positioned between said first and second jaws, with at least one gripping side of the outer surface of the first jaw and at least one gripping side of the outer surface of the second jaw suitably adapted to being simultaneously engaged by a clamping device, said clamping device suitably adapted to move the first and second jaws toward each other and against the threaded rod causing said first and second jaws to exert sufficient pressure on the threaded rod such that a rotational movement of the hand tool results in a corresponding movement of the threaded rod.

5. The hand tool of claim 4 further comprising a hinge, said hinge having a first end and a second end, with said first end of the hinge attached to the first face of the first jaw and said second end of the hinge attached to the first face of the second jaw, such that the first jaw and the second law lie in substantially the same plane and the inner surface of the first jaw is oriented towards the inner surface of the second jaw, with said hinge suitably adapted to permit movement of the first and second jaws toward and away from each other.

6. A hand tool suitable for use with a threaded rod, said threaded rod having a core and an external thread formed thereon with a given nominal diameter, pitch, thread profile, thread count, and depth, said external thread further having a pair of flanks extending from the core and meeting at a crest, said hand tool comprising a first jaw, said first jaw having an inner surface, with said inner surface of the first jaw being concave and having a shape substantially corresponding to an arc of a circle having a diameter slightly larger than the nominal diameter of the external thread of the threaded rod, said arc having a length L, L being less than the circumference of said circle, and said inner surface of the first jaw having a series of internal screw threads formed thereon, each said internal screw thread having the same pitch, thread profile, and thread count as the external thread on the threaded rod and further having a pair of flanks extending from the inner surface of the first jaw and meeting at a crest, said internal screw threads suitably adapted for mating engagement with the external thread on the threaded rod, wherein for each internal screw thread of the inner surface of the first jaw, each said internal screw thread has a depth greater than the depth of the external thread of the threaded rod, whereby the crest of each said internal screw thread contacts the core of the threaded rod between the flanks of the external thread of the threaded rod during engagement of the first jaw with the threaded rod and the crest of the external thread of the threaded rod does not contact the inner surface of the first jaw, and for all internal screw threads of the inner surface of the first jaw all said internal screw threads have substantially the same depth, with their being slight clearances between the flanks of said internal screw threads and the flanks of the external thread of the threaded rod when the first jaw is engaged with the threaded rod, and said first jaw having an outer surface; and a second jaw, said second jaw having an inner surface, with said inner surface of the second jaw being concave and having a shape substantially corresponding to an arc of said circle, said arc having a length L' less than or equal to the circumference of said circle less length L, and said inner surface of the second jaw having a series of internal screw threads formed thereon, each said internal screw thread having the same pitch, thread profile, and thread count as the external thread on the threaded rod and further having a pair of flanks extending from the inner surface of the second jaw and meeting at a crest, said internal screw threads suitably adapted for mating engagement with the external thread on the threaded rod, wherein for each internal screw thread of the inner surface of the second jaw, each said internal screw thread has a depth greater than the depth of the external thread of the threaded rod, whereby the crest of each said internal screw thread contacts the core of the threaded rod between the flanks of the external thread of the threaded rod during engagement of the second jaw with the threaded rod and the crest of the external thread of the threaded rod does not contact the inner surface of the second jaw, and for all internal screw threads of the inner surface of the second jaw all said internal screw threads have substantially the same depth, with their being slight clearances between the flanks of said internal screw threads and the flanks of the external thread of the threaded rod when the second jaw is engaged with the threaded rod, and said second jaw having an outer surface;

whereby the first and second jaws of the hand tool are simultaneously engaged upon opposite sides of the threaded rod, said first and second jaws lying in substantially the same plane and said threaded rod positioned between said first and second jaws, with contact between the first jaw and the threaded rod taking place primarily between the crests of the internal screw threads of the first jaw and the core of the threaded rod between the flanks of the external thread when the first jaw of the hand tool is engaged with the threaded rod, and contact between the second jaw and the threaded rod taking place primarily between the crests of the internal screw threads of the second jaw and the core of the threaded rod between the flanks of the external thread when the second jaw of the hand tool is engaged with the threaded rod, thereby reducing the risk of damage to the external thread of the threaded rod during engagement, with said first jaw and said second jaw suitably adapted to be moved toward each other and against the threaded rod causing said first and second jaws to exert sufficient pressure on the threaded rod such that a rotational movement of the hand tool results in a corresponding movement of the threaded rod.

* * * * *